US007731888B2

(12) United States Patent
Nowicky et al.

(10) Patent No.: US 7,731,888 B2
(45) Date of Patent: Jun. 8, 2010

(54) MOLD DEVICE AND METHOD FOR FORMING A LOCK BORE

(75) Inventors: David A. Nowicky, Fairport, NY (US); Christine M. Keane, Rochester, NY (US); James W. Hall, Ontario, NY (US); Douglas E. Shaffer, Victor, NY (US); Philip B. Race, Macedon, NY (US); David P. Fisher, Walworth, NY (US)

(73) Assignee: John D. Brush & Co., Inc., Rochester, NY (US)

( * ) Notice: Subject to any disclaimer, the term of this patent is extended or adjusted under 35 U.S.C. 154(b) by 0 days.

(21) Appl. No.: 12/354,345

(22) Filed: Jan. 15, 2009

(65) Prior Publication Data

US 2009/0121389 A1 May 14, 2009

Related U.S. Application Data

(62) Division of application No. 11/814,189, filed as application No. PCT/US2006/002159 on Jan. 20, 2006, now abandoned.

(60) Provisional application No. 60/645,979, filed on Jan. 21, 2005.

(51) Int. Cl.
*B29C 49/00* (2006.01)

(52) U.S. Cl. ..... 264/438; 264/523; 425/438; 425/522; 425/DIG. 58; 411/21

(58) Field of Classification Search ..... 425/522, 425/525, DIG. 58; 411/21, 347, 348; 403/367, 403/409.1, 374.1; 264/523, 318; *B29C 49/54*
See application file for complete search history.

(56) References Cited

U.S. PATENT DOCUMENTS 13,722 A 10/1855 Homes et al.
589,780 A 9/1897 Howard (Continued)

OTHER PUBLICATIONS

International Searching Authority, "International Search Report," mailed Dec. 13, 2006, issued for application No. PCT/US06/02159, filed Jan. 20, 2006, applicant John D. Brush & Co.

(Continued)

*Primary Examiner*—Joseph S Del Sole
*Assistant Examiner*—Ninh V Le
(74) *Attorney, Agent, or Firm*—Woods Oviatt Gilman LLP

(57) ABSTRACT

A locking mechanism for an enclosure is provided. The enclosure comprises a base including a locking groove formed therein, and a lid pivotally coupled with the base having a lock bore formed therein. The lock mechanism is mounted in the lock bore and includes a pin that is selectively positioned within the locking groove to secure the lid to the base. Also provided is a molding device and method for forming the lock bore. The mold device includes a base member with a pair of arms having a mold protrusion and a lower cam surface. The molding device also includes a housing having a pair of mold protrusion openings. The mold protrusions selectively extend outwardly through mold protrusion openings when a wedge engages the lower cam surfaces on the arms, wherein the arms spread apart from one another to form a pair of snap grooves in the lock bore.

27 Claims, 6 Drawing Sheets

U.S. PATENT DOCUMENTS

| | | | |
|---|---|---|---|
| 990,460 | A | 4/1911 | Skelton |
| 1,405,524 | A | 2/1922 | Lau |
| 1,563,070 | A | 11/1925 | Brandau |
| 1,652,548 | A | 12/1927 | Wensel |
| 2,093,038 | A | 9/1937 | Douglas |
| 3,135,542 | A | 6/1964 | Wilkinson |
| 3,465,557 | A | 9/1969 | Ryder |
| 3,736,007 | A | 5/1973 | Heilhecker et al. |
| 4,106,317 | A | 8/1978 | Anderson |
| 4,317,516 | A | 3/1982 | Palmer-Ball |
| 4,494,781 | A | 1/1985 | Lafosse |
| 4,541,545 | A | 9/1985 | Beattie et al. |
| 5,076,080 | A | 12/1991 | Fuss et al. |
| 5,259,689 | A | 11/1993 | Arand et al. |
| 5,377,514 | A | 1/1995 | Robbins et al. |
| 5,971,515 | A | 10/1999 | Baker et al. |

OTHER PUBLICATIONS

International Searching Authority, "Written Opinon of the International Searching Authority," mailed Dec. 13, 2006, issued for application No. PCT/US06/02159, filed Jan. 20, 2006.

Gall, Lloyd A., Non-Final Office Action, Mailed Aug. 25, 2008 for U.S. Appl. No. 11/814,189, Alexandria, VA.

Gall, Lloyd A., Non-Final Office Action, Mailed Feb. 19, 2009 for U.S. Appl. No. 11/814,189, Alexandria, VA.

MOLD DEVICE AND METHOD FOR FORMING A LOCK BORE

CROSS-REFERENCE TO RELATED APPLICATIONS

This is a divisional application of U.S. patent application Ser. No. 11/814,189, filed on May 6, 2008, which is now abandoned, which is a National Stage filing under 35 U.S.C. §371 of International Application No. PCT/US2006/002159, filed Jan. 20, 2006, which in turn claims the benefit of U.S. Provisional Application No. 60/645,979, filed Jan. 21, 2005.

BACKGROUND OF THE INVENTION

The present invention relates to a lock mechanism for an enclosure. In particular, the lock mechanism of the present invention is mounted in a lid of the enclosure. More particularly, the lock mechanism is mounted in a lock bore formed in the lid of the enclosure and extends into an interior compartment of the enclosure to selectively engage a base of the enclosure with the lid. The present invention also includes a molding device and method for forming the lock bore for the locking mechanism.

It is known to use a locking mechanism to secure the interior compartment of a fire-resistant safe or enclosure. For example, the locking mechanism may be a key lock that is used to secure the safe's lid to a base, such as in U.S. Pat. No. 5,377,514 to Robbins et al. In particular, this type of lock mechanism may include a lock latch that is coupled with the key lock and pivotally mounted within a lower escutcheon plate. The lock latch may be selectively coupled with a pin mounted within an upper escutcheon plate to secure the base to the lid when a corresponding key is used to rotate the key lock.

The key-type locking mechanism as discussed above suffers from a number of drawbacks and deficiencies. For instance, while the lock latch and pin are located within the upper and lower escutcheon plates, respectively, these components may be accessed and manipulated to unlock the safe if the top or bottom escutcheon plates are damaged or intentionally broken. Furthermore, the fact that the lock latch and pin are located outside the confines of the fire-resistant lid and base make these components susceptible to melting when exposed to elevated temperatures, such as during a fire. As a result, the locking mechanism will no longer operate to secure the internal compartment of the safe. In addition, the use of top and bottom escutcheon plates to provide a mounting location for the lock latch and the pin increases the cost of manufacturing the safe and may take away from the overall appearance of the safe.

Accordingly, there exists a need for an enclosure that eliminates the need for mounting the top and bottom escutcheon plates in order to reduce manufacturing costs, reduce the chance that the enclosure will be accessed by an unauthorized user, and improve the appearance of the enclosure. The present invention fills these needs as well as other needs.

SUMMARY OF THE INVENTION

In order to overcome the above stated problems and limitations, there is provided a lock mechanism for an enclosure or safe. In general, the enclosure includes a base and a lid. The base includes a locking groove formed therein, and the lid is pivotally coupled with the base. The lid has a lock bore formed therein, and the lid and the base define an interior compartment. The lock mechanism is positioned in the lock bore and includes a pin that is selectively positioned within the locking groove to secure the lid to the base to prevent access to the interior compartment.

The lock mechanism is mounted to a lid of the safe thereby eliminating the need to use top and bottom escutcheon plates on the front portion of the safe. Eliminating the need for escutcheon plates on the front of the safe to mount the lock mechanism allows the fill ports on the safe to be moved to the rear portion of the safe, which gives the outer appearance of the safe a cleaner, more aesthetically pleasing appearance. Further, the lock mechanism is located within the lid and extends into an interior compartment of the safe whereby the lock mechanism is selectively engaged with a base of the safe thereby coupling the lid with the base. By positioning the lock mechanism within the lid and interior compartment of the safe, the chance that the locking mechanism will be tampered with and unlocked by an unauthorized user is reduced.

The present invention also includes a mold device for forming the lock bore. The mold device includes a base member having a pair of arms extending therefrom, each of the arms having a mold protrusion and a lower cam surface. The mold device also includes a wedge positioned between the arms and slidably coupled with the base member. A housing is coupled with the base member and includes an aperture defined therein that allows the arms to be positioned therein. The housing also includes a pair of mold protrusion openings defined therein, wherein the mold protrusions selectively extend outwardly through mold protrusion openings when the wedge engages the lower cam surfaces on the arms so that the arms are spread apart from one another.

The present invention also includes a method of forming the lock bore in a safe, wherein the safe includes a base pivotally coupled with a lid. The method includes providing a base member including a pair of arms extending therefrom, each of the arms having a mold protrusion and a lower cam surface; providing a wedge positioned between the arms and slidably coupled with the base member; providing a housing coupled with the base member, the housing including an aperture defined therein that allows the arms to be positioned therein, the housing including a pair of mold protrusion openings defined therein; and forming one of the lid or the base, wherein when the lid or base is being formed, the housing is in a position to form the lock bore in the lid or base, wherein when the lock bore is being formed, the wedge is moved so that the wedge engages the lower cam surfaces on the arms whereby the mold protrusions extend outwardly through mold protrusion openings to form a pair of snap grooves in the lid or the base.

BRIEF DESCRIPTION OF THE SEVERAL VIEWS OF THE DRAWINGS

The above-mentioned and other features and advantages of this invention, and the manner of attaining them, will become apparent and be better understood by reference to the following description of one embodiment of the invention in conjunction with the accompanying drawings, wherein.

DETAILED DESCRIPTION OF THE INVENTION

Figure 1:
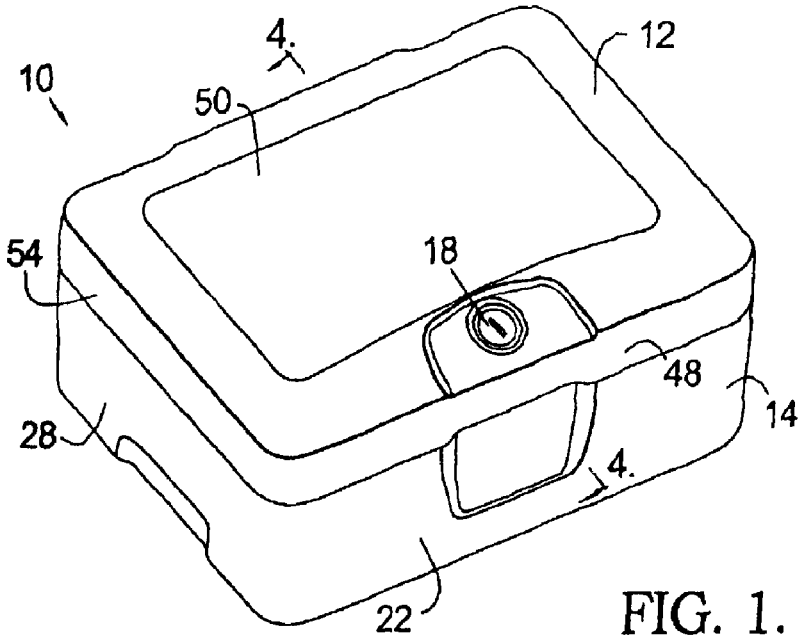
FIG. 1 is a front perspective view of a safe including a lock mechanism in accordance with the present invention.
Figure 2:
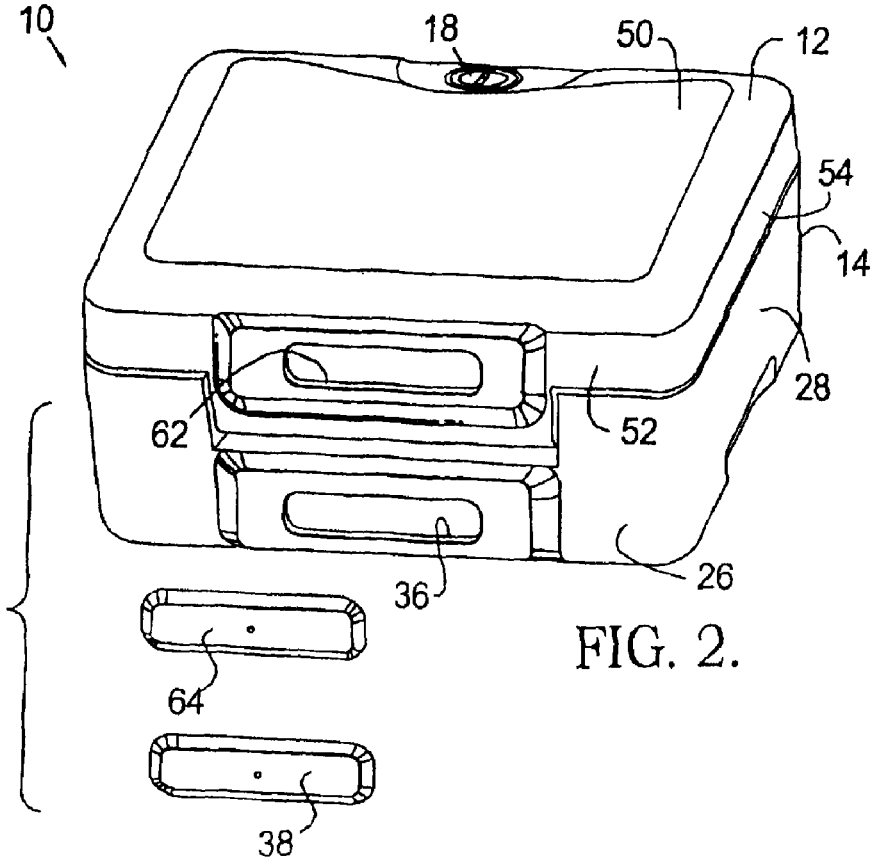
FIG. 2 is a rear perspective view of the safe shown in FIG. 1 showing the fill caps exploded outwardly from the safe.
Figure 3:
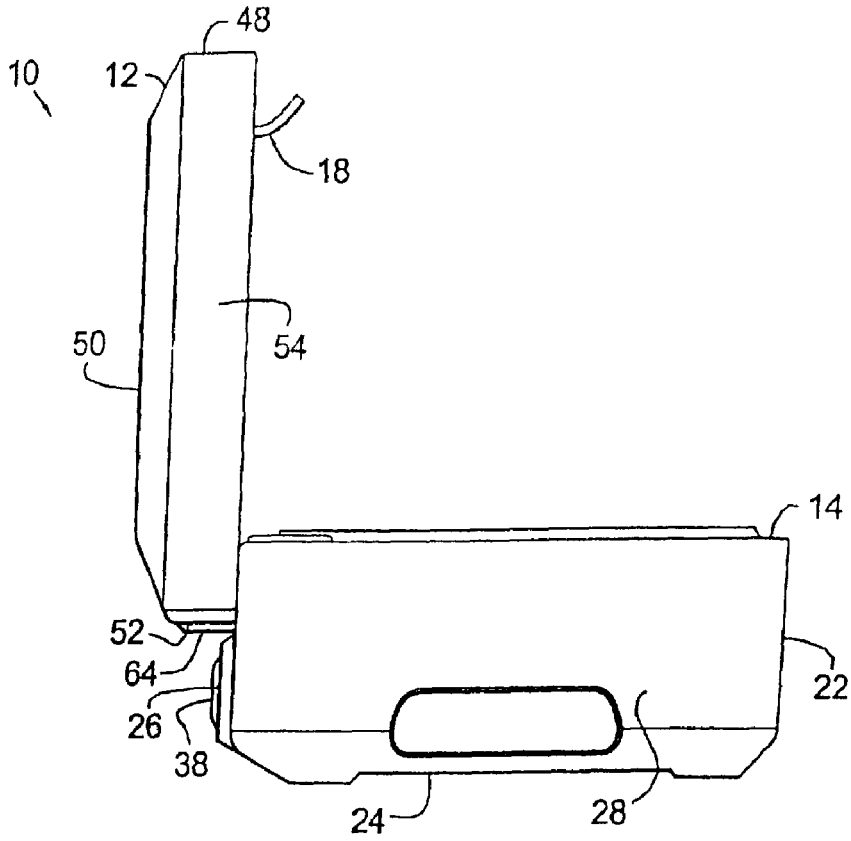
FIG. 3 is a side elevation view of the safe shown in FIG. 1 in an opened position.

Referring to the drawings in detail, and particularly FIGS. 1-4, there is shown a safe or enclosure 10 having a lid 12 hingedly coupled with a base 14. Lid 12 and base 14 define an interior compartment 16 that may be secured by a lock mechanism 18. In particular, lock mechanism 18 may be mounted within a lock bore 20 defined in lid 12. Lock mechanism 18 is positioned within lock bore 20 so that lock mechanism 18 may extend into interior compartment 16 and operate to selectively fasten base 14 with lid 12.

Figure 8:
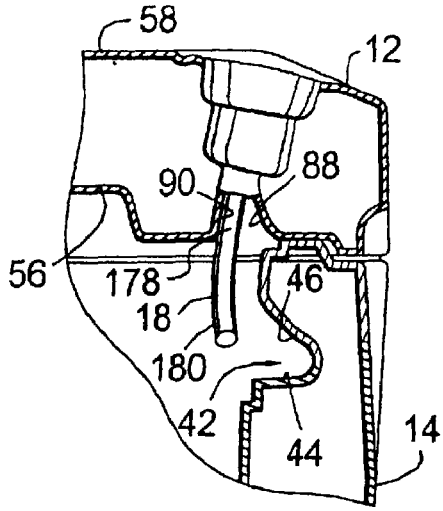
FIG. 8 is a partial cross-sectional view similar to FIG. 7 showing the lock mechanism in an unlocked position.

Base 14 generally includes a front wall 22, a bottom wall 24, a rear wall 26, and a pair of side walls 28. Base 14 may further include an inner shell 30 and an outer shell 32 that define a space, which may be filled with a fire-resistant insulation material 34. Specifically, the insulation material 34 may be filled into the space between inner and outer shells 30, 32 through a fill port 36 defined in rear wall 26 of base 14. After insulation material 34 is filled between inner and outer shells 30, 32, a fill cap 38 may be fastened to fill port 36 using snap arms 40. Front wall 22 of base 14 also has a locking groove 42 defined in inner shell 30. As best seen in FIG. 8, locking groove 42 includes a lower wall 44 and an upper wall 46 that is angled so that it will accept lock mechanism 18. For example, upper wall 46 may be positioned at approximately a forty-five degrees angle relative to lower wall 44.

Lid 12 generally includes a front wall 48, a top wall 50, a rear wall 52, and a pair of side walls 54. Lid 12 may further include an inner shell 56 and an outer shell 58 that define a space that may be filled with a fire-resistant insulation material 60. The insulation material 60 may be filled into the space between inner and outer shells 56, 58 through a fill port 62 defined in rear wall 52 of lid 12. After insulation material 60 is filled between inner and outer shells 56, 58, a fill cap 64 may be fastened to fill port 62 using snap arms 66. Furthermore, lock bore 20 may be defined in lid 12 to provide a mounting location for lock mechanism 18.

Figure 5:
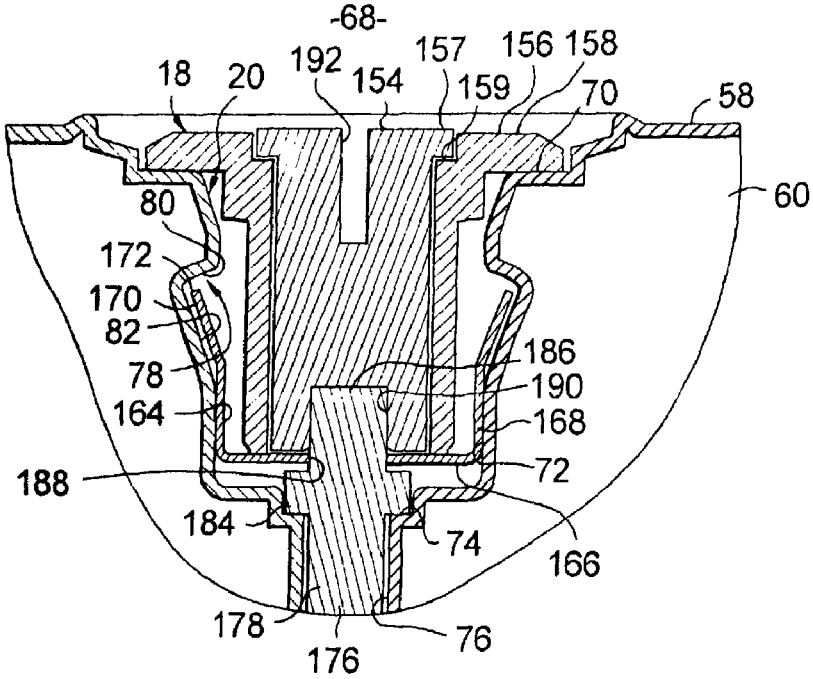
FIG. 5 is an enlarged view of a portion of the lock mechanism shown in FIG. 4 designated by the number "5"
Figure 9:
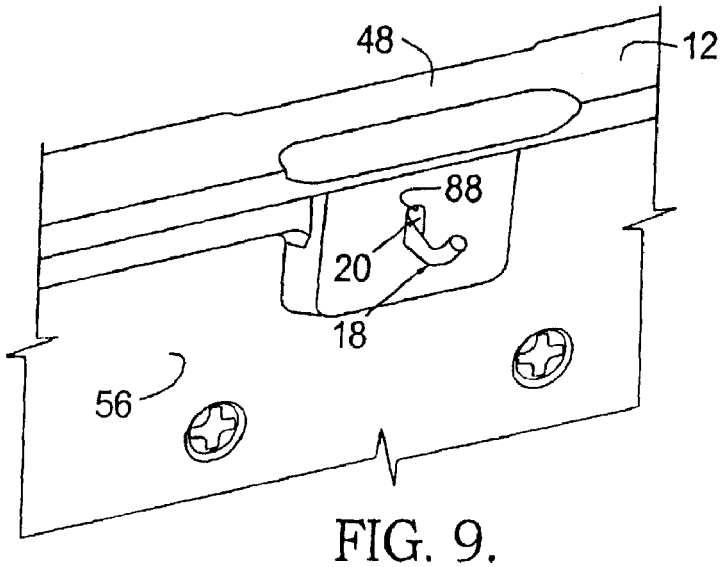
FIG. 9 is a partial perspective view of the inner wall of the safe's lid showing a portion of the locking mechanism.
Figure 11:
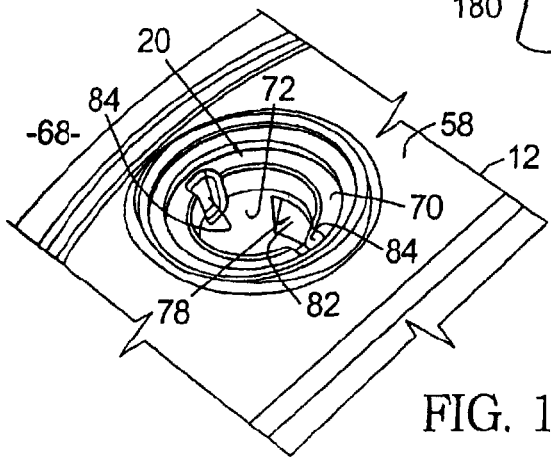
FIG. 11 is a partial perspective view of the safe' lid having a lock bore formed therein.

As best seen in FIGS. 5, 9 and 11, lock bore 20 is formed in lid 12 and extends from an external environment 68 to interior compartment 16 of safe 10. Specifically, lock bore includes a ridge 70, a main section 72, a ledge 74, and a pin section 76. Main section 72 includes a pair of snap grooves 78, each having an upper stop surface 80 and an outer surface 82. Upper stop surface 80 operates to retain lock mechanism 18 within lock bore 20, and will be discussed in more detail below. Further, a notch 84 may be formed in main section 72 to properly align lock mechanism 18 in lock bore 20, and prevent lock mechanism 18 from rotating within lock bore 20.

Figure 4:
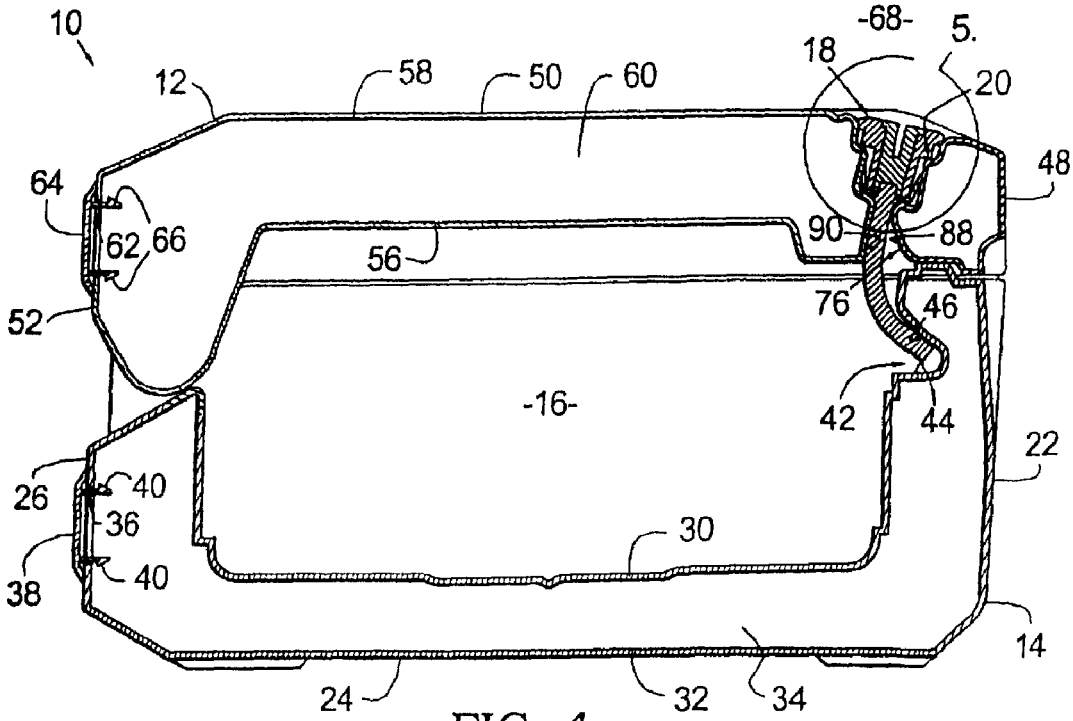
FIG. 4 is a cross-sectional view taken along line 4-4 in FIG. 1.
Figure 7:
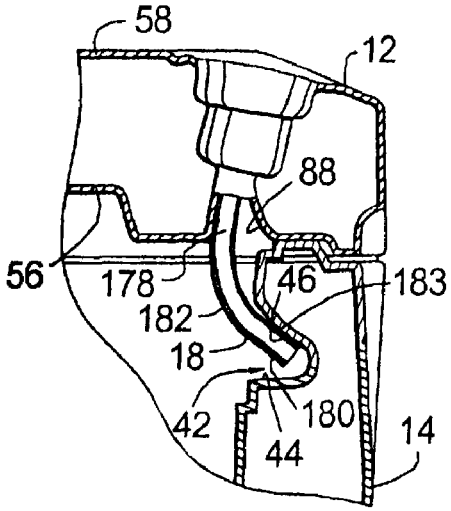
FIG. 7 is a partial cross-sectional view showing the lock mechanism in a locked position.

With additional reference to FIGS. 4 and 7, a front portion 88 of pin section 76 tapers away from a back portion 90 and toward front wall 48 as pin section 76 as lock bore 20 extends toward interior compartment 16 of safe 10. The tapered pin section 76 allows lock mechanism 18 to be inserted into lock bore 20 from outside safe 10. While pin section 76 needs to be large enough for lock mechanism 18 to be mounted in lid 14 and extend into interior compartment 16 of safe 10, it is also desirable to minimize the pin section 76 to reduce the exposure of the interior compartment with the external environment when the temperature of the external environment is elevated.

Figure 12:
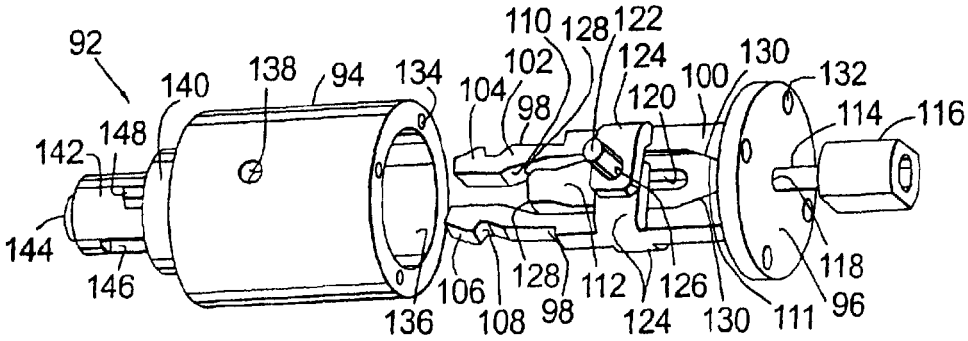
FIG. 12 is a partially exploded view of a mold device according to the present invention that may be used to form the lock bore shown in FIG. 11.

Lock bore 20 and locking groove 42 may be formed during the process of blow-molding inner and outer shells 30, 32, 56, 58 of lid 12 and base 14. In particular, a mold device 92 may be used to form lock bore 20, including snap grooves 78, in lid 12. As best seen in FIG. 12, mold device 92 includes a housing 94 and a disk-shaped base or support member 96 having a pair of arms 98 that extend therefrom. In particular, a first end 100 of each arm 98 is coupled to a flat surface of base member 96, and a second end 102 of each arm 98 includes a mold protrusion or tabs 104. Each of mold protrusions 104 include an outer mold surface 106 for forming outer surface 82 in lock bore 20, and an upper stop mold surface 108 for forming upper stop surface 80 in lock bore 20. Second end 102 of each arm 98 also includes a lower cam surface 110, and first end 100 of each arm 98 includes an upper cam surface 111. Upper and lower cam surfaces 111, 110 on each arm 98 are adapted to come into contact with a wedge 112. Lower cam surfaces 110 on each arm 98 taper toward one another as arms 98 extends toward mold protrusions 104. Further, upper cam surfaces 111 on each arm 98 taper toward one another as arms 98 get further away from mold protrusions 104 and closer to base member 96.

Figure 13:
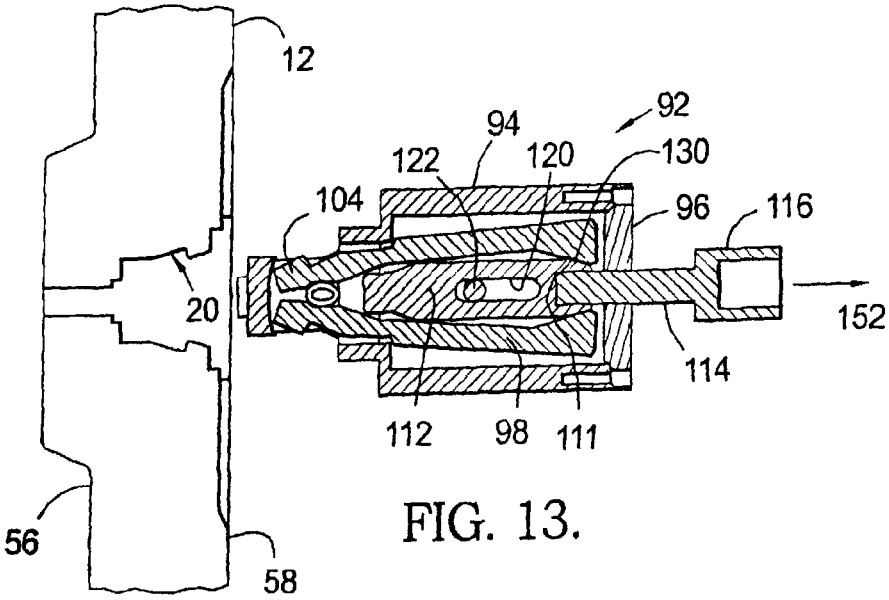
FIG. 13 is a cross-sectional view of the mold device shown in FIG. 12 in a retracted position.
Figure 14:
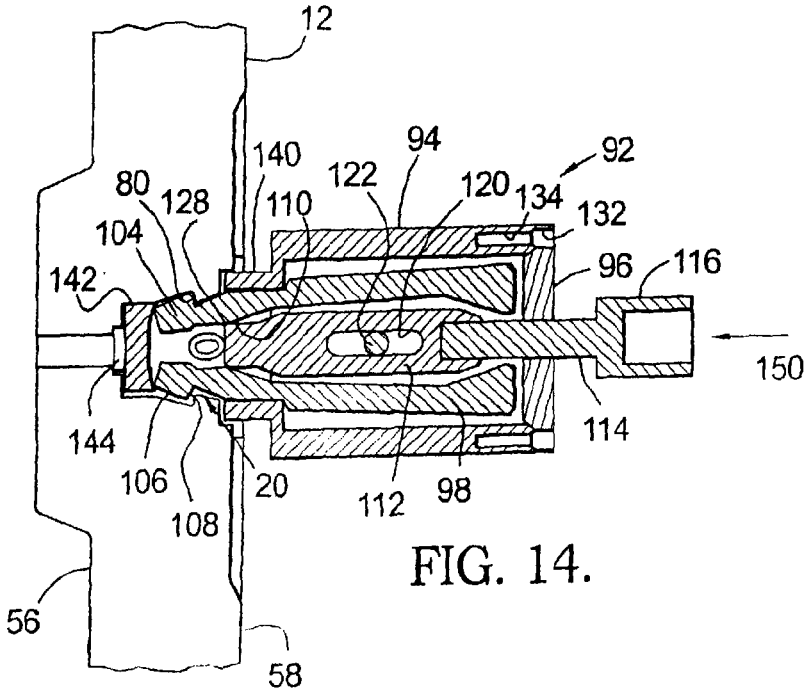
FIG. 14 is a cross-sectional view of the mold device shown in FIG. 12 in an extended position.

Wedge 112 is coupled with an actuator rod 114 and an adaptor 116, which in turn may be coupled with an actuator device (not shown). Actuator rod 114 is positioned within an aperture 118 formed in base member 96 so that actuator rod 114 may be slidably coupled with base member 96. Wedge 112 also has a slot 120 defined therein that is adapted to slidably accept a pin 122. Pin 122 couples the arms 98 to one another and slidably couples wedge 112 in between arms 98. In particular, each arm 98 includes a pair of connectors 124 that extend from an intermediate portion of arm 98 and toward the opposing arm. Connectors 124 from each arm 98 overlap with one another so that holes 126 defined in each connector 124 are aligned. Holes 126 provide a location for pin 122 to pass through and are positioned so that pin 122 also passes through slot 120. Wedge 112 further includes a lower end 128 that is adapted to be selectively engaged with lower cam surfaces 110 to spread second end 102 of arms 98 apart from one another as best seen in FIG. 14 to an extended position. Further, an upper end 130 of wedge 112 is adapted to be selectively engaged with upper cam surfaces 111 to cause second end 102 of arms 98 to retract and move closer to one another, as best seen in FIG. 13. Base member 96 may be coupled with housing 94 by inserting one or more fasteners into the base apertures 132 in base member 96 and the apertures 134 in housing 94.

As best seen in FIG. 12, housing 94 is generally a cylindrical sleeve member having an housing aperture 136 that will accommodate arms 98 and wedge 112. A pin bore 138 is defined in housing 94 and is adapted to accept pin 122. With additional reference to FIG. 5, housing 94 further includes a ridge section 140 that is adapted to form ridge 70, a middle section 142 that is adapted to form main section 72, and a ledge section 144 that is adapted to form ledge 74 in lock bore 20. As best seen in FIG. 12, middle section 142 has a pair of opposing mold protrusion openings 146 (only one shown) that allow mold protrusions 104 to be selectively extended and retracted therefrom to form snap grooves 78 during the process of blow molding of lid 12. Moreover, an alignment protrusion 148 may extend from an outer surface of middle section 142 of housing 94 to form notches 84 in lock bore 20.

Mold device 92 may be moved between a retracted position where mold protrusions 104 on arms 98 are positioned within middle section 142, as best seen in FIG. 13, and an extended position where mold protrusions 104 extend outwardly from mold protrusion openings 146, as best seen in FIG. 14. In the extended position shown in FIG. 14, actuator rod 114 has been moved by an actuating mechanism in a direction 150 so that lower end 128 of wedge 112 engages and slides on lower cam surfaces 110 on each arm 98 at the same time. Wedge 112 thereby operates to spread arms 98 apart simultaneously, which causes mold protrusions 104 to extend out of openings 146. The use of wedge 112 to spread apart opposing arms 98 is advantageous because it causes mold protrusions 104 to extend outwardly at the same distance from mold protrusion openings 146, which in turn produces snap grooves 78 that are uniform and consistent.

At this point, lid 12 may be blow molded such that ridge section 140, middle section 142, and ledge section 144 are in a position to mold lock bore 20, including ridge 70, middle section 72, including snap grooves 78 and ledge 74. Specifically, outer mold surface 106 and upper stop mold surface 108 on each of mold protrusions 104 form a mold for outer surface 82 and upper stop surface 80 in lock bore 20. After inner and outer shells 56, 58 of lid 12 have been formed, as best seen in FIG. 14, mold device 92 must then be removed so that lock mechanism 18 may be mounted within lock bore 20. However, mold device 92 may not be removed in the extended position shown in FIG. 14 because mold protrusions 104 would catch on upper stop surface 80.

In order to remove mold device 92 from lock bore 20, an actuator mechanism moves actuator rod 114 and wedge 112 in a direction 152 so that pin 122 slides within slot 120 to guide wedge 112, as best seen in FIG. 13. As wedge 112 moves in direction 152, lower end 128 of wedge 112 disengages with lower cam surfaces 110, and upper end 130 of wedge 112 engages upper cam surfaces 111 on arms 98. By engaging the upper cam surfaces 111 on arms 98, second end 102 of arms 98, including mold protrusions 104, move toward one another and retract within the confines of middle section 142 so that mold protrusions 104 no longer extend outwardly from mold protrusion openings 146. In this position, mold protrusions 104 will no longer catch on upper stop surfaces 80, which allows mold device to be removed from lock bore 20.

Figure 10:
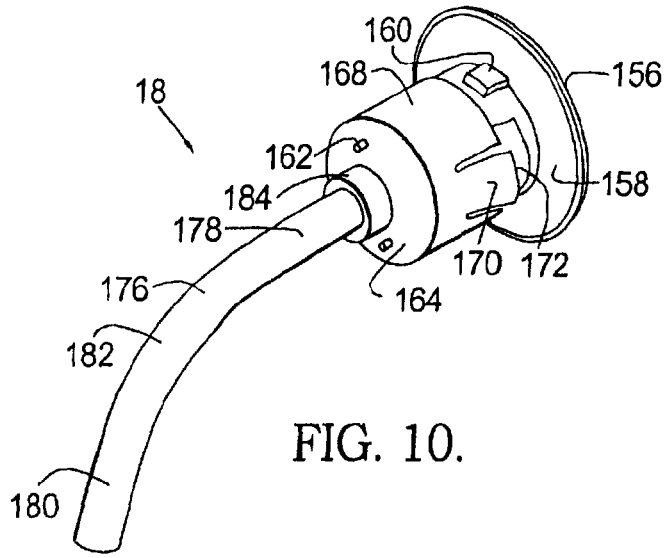
FIG. 10 is a perspective view of the locking mechanism.

After lock bore 20 is formed in lid 12, lock mechanism 18 may be inserted in lock bore 20. As best seen in FIGS. 5 and 10, lock mechanism 18 may generally include a key lock 154 mounted within a housing 156, a lock clip 164, and a pin 176. Key lock 154 includes a key opening 192 adapted to accept a corresponding key that may move lock mechanism 18 between locked and unlocked positions. Key lock is rotatably positioned in housing 156 and includes a flange 157 that engages a stepped surface 159 on housing 156.

Housing 156 includes a collar 158 that is adapted to rest on ridge 70, and a pair of teeth 160 that are adapted to fit within notches 84 (FIG. 11) to properly align and prevent rotation of lock mechanism 18 within lock bore 20. Further, housing 156 includes a pair of posts 162 that are adapted to engage lock clip 164.

Lock clip 164 may be generally cup-shaped and include a base portion 166 with a pair of holes defined therein that accept posts 162 to couple housing 156 with lock clip 164. Lock clip 164 also includes an upright portion 168 having a pair of opposing snap arms or barbs 170 that are angled outwardly relative to upright portion 168. Each of snap arms 170 include a stop edge 172 that is adapted to engage upper stop surface 80 formed in each snap groove 78 to prevent lock mechanism 18 from being removed from lock bore 20.

As best seen in FIGS. 4, 5, 7 and 10, pin 176 includes an upper end 178 that is positioned within pin section 76 of lock bore 20 and coupled with lock clip 164 and key lock 154. Pin 176 also includes a lower end 180 that is adapted to be selectively positioned within locking groove 42. Pin 176 may include a bent section 182 wherein upper end 178 and lower end 180 are angled relative to one another so that pin 176 may be selectively received in locking groove 42. For example, upper end 178 may be angled approximately sixty-five degrees relative to lower end 180. Lower end 180 may include a contact surface 183 that may engage upper wall 46 of locking groove 42 to prevent lid 12 from being opened relative to base 14.

As best seen in FIGS. 5 and 10, upper end 178 of pin 176 includes a shoulder 184 that may come into contact with base portion 166 of lock clip 164. Shoulder 184 is also adapted to rest on ledge 74 of lock bore 20. Further, a distal end 186 of upper end 178 may extend through a central aperture 188 defined in base portion 166 of lock clip 164 and be press-fit into a receiving aperture 190 defined in key lock 154. Key lock 154 and pin 176 are fixedly coupled with one another so that pin 176 may be rotated when a key is inserted into key opening 192 to move lock mechanism 18 between locked and unlocked positions.

Figure 6:
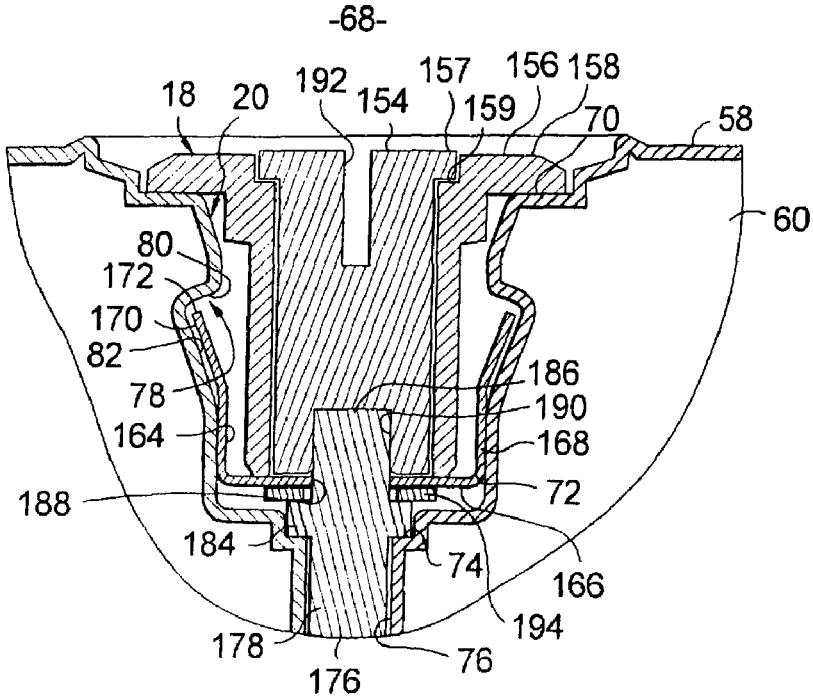
FIG. 6 is an alternative embodiment of the portion of the lock mechanism shown in FIG. 5.

In assembling lock mechanism 18, lock clip 164 is slid onto upper end 178 of pin 176 so that base portion 166 rests on shoulder 184. In the alternative, as best seen in FIG. 6, a fire-resistant washer 194 formed of a wool, including mineral glass, may be positioned on upper end 178 of pin 176 before lock clip 164 so that washer 194 is positioned between shoulder 184 and lock clip 164. With reference to FIGS. 5 and 10, housing 156 is positioned within lock clip 164 so that posts 162 are positioned within the holes formed in base portion 166 of lock clip 164. Key lock 154 is then inserted into housing 156 so that distal end 186 of pin 176 is press-fit within receiving aperture 190, thereby fixedly coupling key lock 154 with pin 176. As key lock 154 is being press-fit on pin 176, flange 157 on key lock 154 engages stepped surface 159 on housing 156 to hold housing 156 within lock clip 164. At this point, lock mechanism 18 is assembled and may be inserted into lock bore 20.

In order to mount the lock mechanism 18 within lock bore 18 formed in lid 12, lower end 180 of pin 176 is fed into lock bore 20 from external environment 68 and inserted into pin section 76. Since pin 176 includes a bent section 182, the front portion 88 of pin section 76 tapers away from back portion 90 and toward front wall 48 as pin section 76 as lock bore 20 extends toward interior compartment 16 of safe 10. The pin section 76 thereby allows pin 176 to extend into interior compartment 16 and in a location to be selectively positioned within locking groove 42. Pin 176 may continue to be inserted into lock bore 20 until shoulder 184 rests against ledge 74. As pin 176 is inserted into lock bore 20, snap arms 170 on lock clip 164 snap outwardly into snap grooves 78. Once snap arms 170 are positioned within snap grooves 78, the stop edge 172 on each of the snap arms 170 may come into contact with upper stop surface 80 to prevent lock mechanism 18 from being removed from lock bore 20 and prevent rotation of lock mechanism 18 within lock bore 20. Furthermore, the teeth 160 formed on housing 156 slide within notches 84 defined in lock bore 20 to prevent lock mechanism from rotating within lock bore 20.

Once lock mechanism 18 is mounted within lock bore 20, lock mechanism 18 may be moved between locked and unlocked positions to selectively allow access to interior compartment 16 of safe 10. As best seen in FIG. 7, lock mechanism 18 is shown in a locked position. In particular, pin 176 is positioned such that lower end 180 is located within locking groove 42 whereby contact surface 183 will come into contact with upper wall 46 of locking groove 42 if an attempt is made to move lid 12 relative to base 14. If a key corresponding to key lock 154 is positioned within key opening 192 and rotated relative to housing 156, then pin 176 will also rotate relative to lid 12 and may move into the unlocked position shown in FIG. 8. In this position, lower end 180 is not positioned within locking groove 42 and lid 12 may be opened relative to base 14 to provide access to interior compartment 16 of safe 10.

The safe 10 may become exposed to a fire that will cause the temperature of external environment 68 to rise to a point that could melt key lock 154, housing 156, and lock clip 164. The lock mechanism 18 may prevent the melted components from entering internal compartment 16 and prevent a rapid temperature increase within internal compartment 16 by forming pin 176 of a material with a high melting temperature, such as steel. In particular, the engagement of shoulder 184 of pin 176 with ledge 74 in lock bore 20 seals off or blocks the pin section 76 from external environment 68 and prevents the melted components from entering internal compartment 16. Also, since washer 194 (FIG. 6) is formed of a fire-resistant material, washer 194 may operate as an additional seal for preventing the melted components from entering internal compartment 16.

While the above description includes positioning the lock bore 20 and lock mechanism 18 in lid 12 and locking groove 42 in base 14, it will be understood and appreciated that the present invention also may include positioning the lock bore 20 and lock mechanism 18 in base 14, and forming locking groove 42 in lid 12.

The present invention overcomes and ameliorates the drawbacks and deficiencies in the prior art. For instance, the lock mechanism of the present invention is mounted to a lid of the safe thereby eliminating the need to use an escutcheon plate on the front portion of the safe, which may reduce manufacturing costs. In addition, eliminating the need for an escutcheon plate on the front of the safe to mount the lock mechanism allows the fill ports on the safe to be moved to the rear portion of the safe, which may give the outer appearance of the safe a cleaner look. Further, the lock mechanism is located within the lid and extends into an interior compartment of the safe. By locating the lock mechanism within the confines of the safe, the chance that the locking mechanism will be tampered with and unlocked by an unauthorized user is reduced. The mold device discussed herein also provides a number of advantages. For example, the mold device includes a pair of arms that simultaneously extend outwardly from a housing at the same distance to provide a mold for a pair of matching snap grooves.

Although the present invention has been described in considerable detail with reference to certain preferred versions thereof, other versions are possible. Therefore, the spirit and scope of the appended claims should not be limited to the description of the preferred versions contained herein.

All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A mold device comprising:

a base member including a pair of arms extending therefrom, each of the arms having a mold protrusion and a lower cam surface;

a wedge positioned between the arms and slidably coupled with the base member;

a housing coupled with the base member, the housing including an aperture defined therein that allows the arms to be positioned therein, the housing including a pair of mold protrusion openings defined therein, wherein the mold protrusions are configured to extend outwardly through mold protrusion openings when the wedge engages the lower cam surfaces on the arms so that the arms are spread apart from one another; and a pin coupled with and positioned between the arms, wherein the wedge has a slot defined therein, and wherein the pin is slidably coupled in the slot.

2. The mold device recited in claim 1, further comprising an actuator rod coupled with the wedge and slidably coupled with the base member.

3. The mold device recited in claim 1, wherein the mold protrusions include an outer mold surface and an upper stop mold surface.

4. The mold device recited in claim 1, wherein the housing includes an alignment protrusion that extends outwardly from an outer surface of the housing.

5. A mold device comprising:

a base member including a pair of arms extending therefrom, each of the arms having a mold protrusion and a lower cam surface;

a wedge positioned between the arms and slidably coupled with the base member; and a housing coupled with the base member, the housing including an aperture defined therein that allows the arms to be positioned therein, the housing including a pair of mold protrusion openings defined therein, wherein the mold protrusions are configured to extend outwardly through mold protrusion openings when the wedge engages the lower cam surfaces on the arms so that the arms are spread apart from one another, wherein the housing further includes a ledge section, a middle section, and a ridge section, wherein each of the sections are cylindrical and have different diameters relative to one another.

6. The mold device recited in claim 5, wherein the ledge section has the smallest diameter relative to the diameters of the middle section and the ridge section, and wherein the ridge section has the largest diameter relative to the diameters of the ledge section and the middle section.

7. The mold device recited in claim 5, wherein the mold protrusion openings are defined in the middle section.

8. The mold device recited in claim 5, wherein the housing includes an alignment protrusion that extends outwardly from the middle section.

9. The mold device recited in claim 1, wherein the arms are simultaneously spread apart from one another by the wedge.

10. The mold device recited in claim 5, further comprising an actuator rod coupled with the wedge and slidably coupled with the base member.

11. The mold device recited in claim 5, wherein the mold protrusions include an outer mold surface and an upper stop mold surface.

12. The mold device recited in claim 5, wherein the housing includes an alignment protrusion that extends outwardly from an outer surface of the housing.

13. The mold device recited in claim 5, wherein the arms are simultaneously spread apart from one another by the wedge.

14. The mold device recited in claim 1, wherein the housing further includes a ledge section, a middle section, and a ridge section, wherein each of the sections are cylindrical and have different diameters relative to one another.

15. The mold device recited in claim 14, wherein the ledge section has the smallest diameter relative to the diameters of the middle section and the ridge section, and wherein the ridge section has the largest diameter relative to the diameters of the ledge section and the middle section.

16. The mold device recited in claim 14, wherein the mold protrusion openings are defined in the middle section.

17. The mold device recited in claim 14, wherein the housing includes an alignment protrusion that extends outwardly from the middle section.

18. A method of forming a lock bore in a safe, the safe including a base pivotally coupled with a lid, the method comprising:

providing a base member including a pair of arms extending therefrom, each of the arms having a mold protrusion and a lower cam surface;

providing a wedge positioned between the arms and slidably coupled with the base member;

providing a housing coupled with the base member, the housing including an aperture defined therein that allows the arms to be positioned therein, the housing including a pair of mold protrusion openings defined therein;

providing a pin coupled with and positioned between the arms, wherein the wedge has a slot defined therein, and wherein the pin is slidably coupled in the slot; and forming one of the lid or the base, wherein when the lid or base is being formed, the housing is in a position to form the lock bore in the lid or base, wherein when the lock bore is being formed, the wedge is moved so that the wedge engages the lower cam surfaces on the arms so that the arms are spread apart from one another whereby the mold protrusions extend outwardly through mold protrusion openings to form a pair of snap grooves in the lid or the base.

19. The method recited in claim 18, wherein the one of the lid or base is formed by blow molding.

20. The method recited in claim 18, wherein an actuator rod is coupled with the wedge and slidably coupled with the base member, whereby the actuator rod is used to move the wedge.

21. The method recited in claim 18, wherein the housing forms a notch in the lid or the base using an alignment protrusion that extends outwardly from an outer surface of the housing.

22. The method recited in claim 18, wherein the arms are simultaneously spread apart from one another by the wedge when forming the snap grooves.

23. A method of forming a lock bore in a safe, the safe including a base pivotally coupled with a lid, the method comprising:

providing a base member including a pair of arms extending therefrom, each of the arms having a mold protrusion and a lower cam surface;

providing a wedge positioned between the arms and slidably coupled with the base member;

providing a housing coupled with the base member, the housing including an aperture defined therein that allows the arms to be positioned therein, the housing including a pair of mold protrusion openings defined therein, the housing further including a ledge section, a middle section, and a ridge section, wherein each of the sections are cylindrical and have different diameters relative to one another; and forming one of the lid or the base, wherein when the lid or base is being formed, the housing is in a position to form the lock bore in the lid or base, wherein when the lock bore is being formed, the wedge is moved so that the wedge engages the lower cam surfaces on the arms so that the arms are spread apart from one another whereby the mold protrusions extend outwardly through mold protrusion openings to form a pair of snap grooves in the lid or the base.

24. The method recited in claim 23, wherein the one of the lid or base is formed by blow molding.

25. The method recited in claim 23, wherein an actuator rod is coupled with the wedge and slidably coupled with the base member, whereby the actuator rod is used to move the wedge.

26. The method recited in claim 23, wherein the housing forms a notch in the lid or the base using an alignment protrusion that extends outwardly from an outer surface of the housing.

27. The method recited in claim 23, wherein the arms are simultaneously spread apart from one another by the wedge when forming the snap grooves.

* * * * *